US010309202B2

(12) United States Patent
Soliman

(10) Patent No.: US 10,309,202 B2
(45) Date of Patent: Jun. 4, 2019

(54) FRACTURING TREATMENT OF SUBTERRANEAN FORMATIONS USING SHOCK WAVES

(71) Applicant: Petro Research and Analysis Corp, Lubbock, TX (US)

(72) Inventor: Mohamed Yousef Soliman, Lubbock, TX (US)

( * ) Notice: Subject to any disclaimer, the term of this patent is extended or adjusted under 35 U.S.C. 154(b) by 0 days.

(21) Appl. No.: 14/932,981

(22) Filed: Nov. 5, 2015

(65) Prior Publication Data

US 2017/0130567 A1 May 11, 2017

(51) Int. Cl.

| | |
|---|---|
| ***E21B 43/26*** | (2006.01) |
| ***E21B 43/24*** | (2006.01) |
| ***E21B 43/247*** | (2006.01) |
| ***E21B 47/06*** | (2012.01) |

(52) U.S. Cl.

CPC ..... *E21B 43/2401* (2013.01); *E21B 43/247* (2013.01); *E21B 43/26* (2013.01); *E21B 47/06* (2013.01)

(58) Field of Classification Search

CPC ..... G01V 1/288; G01V 2210/1234; E21B 43/2401; E21B 47/06; E21B 43/26; E21B 43/247

See application file for complete search history.

(56) References Cited

U.S. PATENT DOCUMENTS

| | | | | |
|---|---|---|---|---|
| 4,169,503 | A | 10/1979 | Scott | |
| 9,951,585 | B1 * | 4/2018 | Volk | E21B 43/003 |
| 2003/0037692 | A1 * | 2/2003 | Liu | C06B 33/00 102/301 |
| 2004/0226715 | A1 * | 11/2004 | Willberg | E21B 47/00 166/250.1 |
| 2005/0125156 | A1 * | 6/2005 | Soliman | E21B 43/26 702/12 |
| 2013/0098257 | A1 * | 4/2013 | Goodridge | F42B 3/113 102/201 |
| 2013/0201787 | A1 * | 8/2013 | Vermilye | G01V 1/42 367/9 |
| 2014/0027110 | A1 * | 1/2014 | Ageev | H05H 1/52 166/249 |
| 2015/0013974 | A1 * | 1/2015 | Mekic | E21B 47/101 166/254.1 |
| 2017/0175505 | A1 * | 6/2017 | Curlett | E21B 43/2401 |

* cited by examiner

*Primary Examiner* — Silvana C Runyan
(74) *Attorney, Agent, or Firm* — Shireen Soliman

(57) ABSTRACT

Applying shock waves using a plasma pulse generation system or other comparable systems, including an acoustic/pressure oscillatory system, would help to enhance the complexity of the far field hydraulic fracture during fracturing shale formation. It would also help in avoiding pre-mature screen out. The critical factor to maximize the desired results is to apply the shock waves at the correct time. By combining shock wave technology with the newly developed fracturing pressure data analysis, it is possible to achieve maximum results.

11 Claims, 2 Drawing Sheets

Comparison of Pressure Histories Plasma Pulse versus other techniques

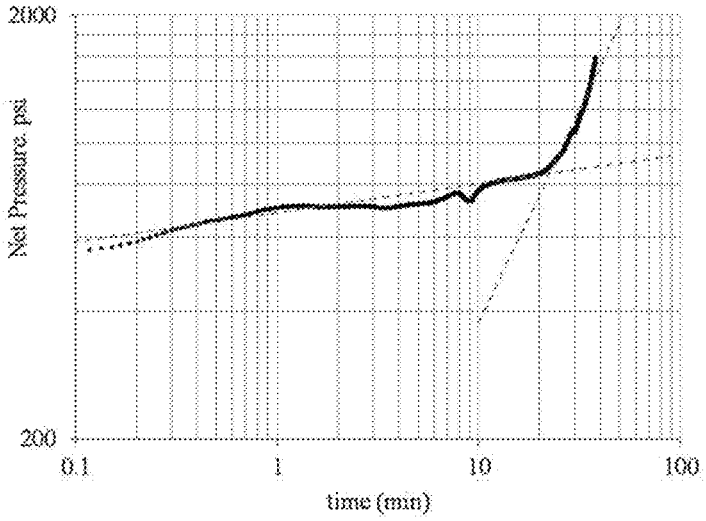
Figure 1
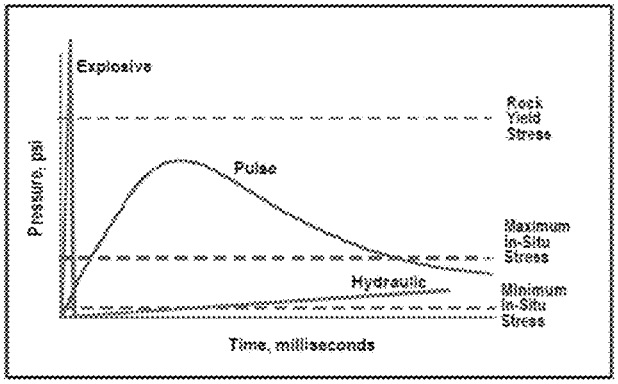
Figure 2: Comparison of Pressure Histories Plasma Pulse versus other techniques

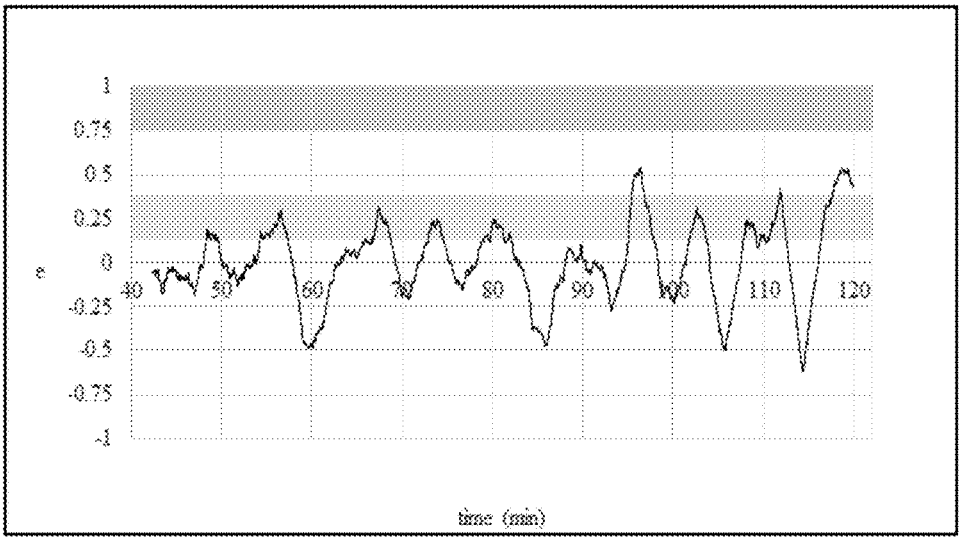
Figure 3 – After Soliman et al 2014
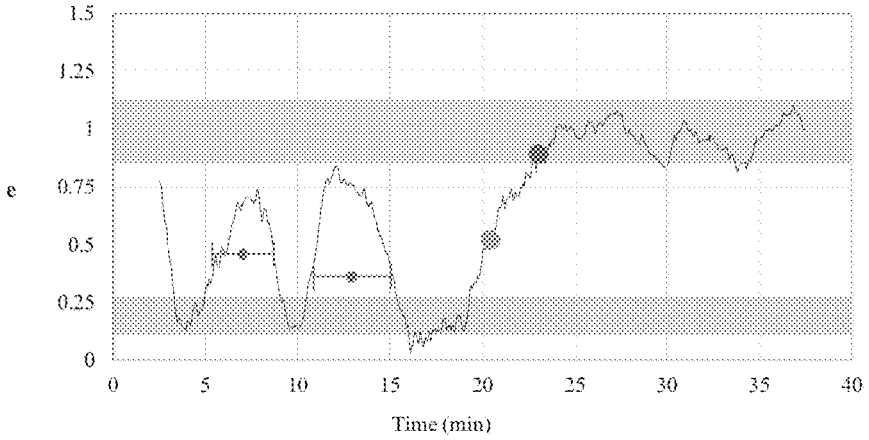
Figure 4 – After Pirayesh, et al 2013

FRACTURING TREATMENT OF SUBTERRANEAN FORMATIONS USING SHOCK WAVES

REFERENCES CITED

Hanson, J. M., Schmidt, R. A., Cooley, C. H., Schatz, J. F, 1984, "Multiple Fracture Stimulation Using Controlled Pulse Pressurization", paper SPE/DOE/GRI 12839 presented at the Unconventional Gas Recovery Symposium, Pittsburg, Pa., USA, May 13-15

Mayerhofer, Michael J, Stegent, Neil Alan, Barth, James O, & Ryan, Kevin M. (2011). *Integrating Fracture Diagnostics and Engineering Data in the Marcellus Shale*. Paper SPE 145463 presented at the SPE Annual Technical Conference and Exhibition, Denver, Colorado, USA, 30 October-2 November. http://dx.doi.org/10.2118/145463-ms.

Nolte, K. G. (1979). *Determination of Fracture Parameters from Fracturing Pressure Decline*. Paper SPE 8341 presented at the SPE Annual Technical Conference and Exhibition, Las Vegas, Nev., 23-26 September. http://dx.doi.org/10.2118/8341-ms.

Nolte, K.G., & Smith, MB. (1981). Interpretation of Fracturing Pressures. *Journal of Petroleum Technology,* 33(9): 1767-1775. SPE 8297. http://dx.doi.org/10.2118/8297-PA.

Nordgren, R. P. (1972). Propagation of a Vertical Hydraulic Fracture. *Society of Petroleum Engineers Journal,* 12(4): 306-314. SPE 3009. http://dx.doi.org/10.2118/3009-pa.

Perkins, T. K., & Kern, L. R. (1961). Widths of Hydraulic Fractures. *Journal of Petroleum Technology,* 13(9): 937-949. SPE 89. http://dx.doi.org/10.2118/89-pa.

Pirayesh, Elias, Soliman, Mohamed Y., & Rafiee, Mehdi. (2013). *Make Decision on the Fly: A New Method to Interpret Pressure-Time Data during Fracturing-Application to Frac Pack*. Paper SPE 166132 presented at the SPE Annual Technical Conference and Exhibition, New Orleans, 30 September-2 October.

Scott, H. Apparatus for Generating a Shock Wave in a Wellbore. U.S. Pat. No. 4,169,503

Soliman, M. Y., East, Loyd, & Adams, David. (2008). Geomechanics Aspects of Multiple Fracturing of Horizontal and Vertical Wells. *SPE Drilling & Completion,* 23(3): 217-228. SPE 86992. http://dx.doi.org/10.2118/86992-pa.

Soliman, M. Y, Wigwe, A. Alzahabi, E. Pirayesh, N. Stegent. 2014. Analysis of Fracturing Pressure Data in Heterogeneous Shale Formations. Volume 1 - Number 2, Hydraulic Fracturing Journal, April 2014, pp 8-13

Vovechenko, A., et al. "Developments of Pulsed Power Industrial Applications at the Institute of Pulse Research and Engineering (IPRE)," Pulsed Power Plasma Science, 2001. PPPS-2001. Digest of Technical Papers

BACKGROUND OF THE INVENTION

Field of invention

This invention is related to hydraulic fracture intervention to enhance fracture complexity in naturally fractured formations particularly shale formations and/or avoid premature sand out.

Setting of the invention

Wells are usually fractured to either make wells economical or to improve the economic value of a well. Injecting fluid, commonly termed fracturing fluid, at a high enough rate and pressure to break down the formation initiates a hydraulic fracture. Continuing to inject the fracturing fluid at the said high rate and pressure propagates the fracture and increases the dimensions of said fracture. This process may be referred to as fracturing the rock by hydraulic means. A proppant-carrying slurry is used to make sure that the fracture is still open and has high permeability after the all fluid has leaked reaching fracture "closure". It is important to monitor the fracturing treatment to make sure that the treatment is progressing satisfactorily. It is also important to have the ability to monitor a fracturing treatment progress and quickly and accurately determine when intervention may be necessary to either enhance the treatment or to avoid potential problem. For example, recognizing when a fracture crosses a swarm of natural fractures is crucial in making a reliable decision to enhance complexity. This capability may be crucial to fracturing shale formations where far field fracture complexity is highly desired. In other cases, recognizing imminent sand out may be another crucial factor in determining an appropriate strategy.

Applying the right intervention technique is extremely important. This patent describes the a method to recognize and apply such remedial technique

SUMMARY OF THE INVENTION

In this invention, a fracture is initiated and the fracturing pressure is monitored. Downhole pressure is preferred; however surface pressure with adequate friction correlation would be appropriate. The observed pressure is then plotted in real-time using the technique described in the body of the patent. In the preferred embodiment of the invention, a shock wave is applied at the time the propagating hydraulic fracture crosses the natural fractures. Another application is to apply the shock wave when it appears that sand-out is imminent and the operator wishes to create a longer fracture.

BRIEF DESCRIPTION OF THE DRAWING

FIG. 1 is a drawing of the net fracturing pressure versus time in log-log scale.

FIG. 2 is a drawing of the Comparison of Pressure Histories Plasma Pulse versus other techniques FIG. 3 is a drawing of the detailed exponent e versus time of Shale Example FIG. 4 is a drawing of the detailed exponent e versus time of FracPack Example

DETAILED DESCRIPTION OF THE INVENTION

Using the fracture propagation model developed by Perkins and Kern (1961) and refined by Nordgren (1972), which assumes that the fracture propagation is a smooth function of time where the term t is time measured from the start of the fracturing treatment, the fracturing pressure at the wellbore may be written as a power function of time as given in equation 1.

$$p_{net} \alpha t^{e},\ \frac{1}{8} \le e \le \frac{1}{5} \qquad 1$$

A large exponent is an indication of low leak-off rate. In other words, more fluid is maintained inside the fracture and contributes to fracture propagation. The bounds given in equation 1 are based on a Newtonian fluid, which was generalized by Nolte (1979) to the following form:

$$\frac{1}{4n+4} \le e \le \frac{1}{2n+3} \quad (1)$$

Using dimensional analysis, Nolte and Smith (1981) reached the conclusion that there are four modes of fracture propagation. Beginning with the start of the fracturing treatment, each of those modes is defined by a specific slope on a plot of log of $p_{net}$ vs. log of time. Four basic modes were described by Nolte and Smith 1) a mode where a small positive slope on the log-log plot is observed and indicates that the fracture is propagating normally and 2) a mode where a unit slope on the log-log plot is observed and identified to mean a screen-out mode (FIG. 1). 3) a mode when pressure drops rapidly and is usually the sign of uncontained fracture height growth or more accurately increase in area available for leak-off, and 4) an elongated flat pressure for which there may be multiple explanations. Based on the succeeding pressure trend, several interpretations are possible for the modes 3 and 4, which include rapid height growth, increasing fracture compliance, and opening of fissures.

The assumptions noted by Nolte and Smith (1981) include linearly elastic behavior of the rock, the creation of bi-wing planar fractures, and constant fracture height. In addition to these assumptions, the analysis has two additional implied assumptions. The first implied assumption is that the injection rate is constant. The second implied assumption is that the fracture propagation is continuous (smooth function of time). Furthermore, because the analysis is based a log-log interpretation of pressure drop (fracture propagation pressure minus fracture closure versus time), to ensure correct interpretation of fracturing events, Nolte-Smith analysis necessitates precise knowledge of fracture closure pressure (Nolte and Smith 1981).

This requires conducting of pre-fracturing tests, such as minifrac tests, that are not routinely performed in every fracturing job. This issue is furthered with the increasing application of multi-stage multi-cluster fracturing schemes where the subsequent fracturing stages experience higher ISIP's and thus higher closure stresses (Soliman et al., 2008 and Mayerhofer et al., 2011).

Pirayesh, et al 2013 developed a newer analysis technique to evaluate fracturing pressure to determine fracturing events, specifically the potential of sandout. Using his technique, the fracture is hypothesized to go through a series of propagation and dilation. The fracturing behavior is hypothesized to be intermittent, rather than continuous as assumed by all previous researchers. The new technique requires moving the reference point, which means that time axis continues to restart. In addition, the technique did not require knowledge of the fracture closure pressure, which is a significant advantage (Pirayesh, et al 2013).

Soliman, et al (2014) used the technique described by Pirayesh, et al to show that by using Pirayesh, et al technique, it is possible to determine when hydraulic fractures intersect swarms of natural fractures. Soliman et al, (2014) teaches that every time the propagating hydraulic fracture intersects a natural fracture or swarms of natural fractures, fracturing fluids leak quickly into the natural fracture, changing the fracturing index and fracture propagating mode. The fracture propagating mode is indicated by a declining fracturing index reaching a negative value that may be as low is −0.5. (Soliman et al 2014). The approach developed by Pirayesh, et al and expanded by Soliman, et al may be easily implemented as a real-time application.

Applying a high pressure pulse to the hydraulic fracturing process at the time the hydraulic fracture intersects a swarm of natural fractures will cause the natural fractures open and will probably exhibit some shear effect. This pulse will enhance the complexity of the hydraulic-natural fractures intersection. Since the pressure pulse moves at the speed of sound, there is sufficient time to apply the pressure pulse and obtain the desired complexity effect.

Another application is when sand out appears to be in the horizon. Sand out may be due to sand bridging inside the hydraulic fracture. Applying a shock wave would dislodge the bridging proppant, which would result in an extension of the fracture length. There are numerous methods to apply the pressure pulse, some of which are plasma pulse, ignition of highly flammable material, and ignition of propellant or jet fuel, which may be solid or liquid. Other methods that may work, but may not be as efficient as the previously mentioned techniques, include the release of highly pressurized liquid or gas, oscillating pressure signal produced on command, and production of acoustic signal. Since one would expect the created hydraulic fracture to intersect multiple natural fracture swarms, the ability to repeat application of pressure pulse is highly desirable. Many of the methods listed earlier offer the capability of repeated pulse at will and consequently would be applicable.

The preferred embodiment is the application of plasma signal. Reasons behind this choice are:

The relative safety of the application since no fuel is burning,

The ability to reach a high pressure pulse,

The ability to tailor the produced pressure pulse for duration and amplitude,

Relatively simple design, with no significant change for multiple pulses, and

The ability to apply a relative large number of pulses.

Plasma Pulsing

Plasma stimulation is a promising technology that utilizes the electrical discharges in liquid, high-voltage pulse capacitors, switches, charging devices, or power-conditioning elements to create a high pressure pulse. Controlled shock wave pulses created by electric discharge and plasma interactions inside liquid-filled wellbores move at speed of sound in the liquid-filled medium. If a hydraulic fracture exists that is open and full of liquid fracturing fluid, the pressure pulse will move at the speed of sound through the liquid fracturing fluid and reach the fracture tip in less than a second, assuming that the speed of sound in water is 1125 ft/sec and the majority of fracture length (one wing) is significantly less than 1000 ft. One great advantage plasma pulse has is the ability to tailor the pulse and to repeat the pulse. FIG. 2 demonstrates the rate and time period over which explosives, hydraulic systems, and plasma pulse deliver power to the rock formation.

Plasma-Fracturing Technology Link

Pulsed power technologies refer to power sources creating high levels of energy during very short times. This technology is adapted to create shock wave around the wellbore by generating electrical pulses within a liquid-filled cavity. In pulsed power technology, a bank of high-voltage capacitors are charged to a desired energy level using traditional electrical power supply of 220VAC, and discharged in nanosecond to microsecond windows to create high current electrical pulses in a liquid fracturing fluid filled borehole. The expanding plasma creates shock waves travelling from the liquid fracturing fluid through the hydraulic fractures into the natural fractures and to the tip of the hydraulic fracture, transforming into stress waves on the natural fractures and the area of sand-out blockage. Depending on the fusible element, the plasma may interact with the fracturing fluid to produce a significant additional pressure wave. The shock wave will change the way in which the fracture is propagating.

Plasma stimulation is based on high frequency pulsed power technology and its effect on nano-aluminium, (or Lithium-Aluminum alloys) which has been well researched during the Cold War period. This plasma stimulation may be effective in stimulating low permeability formations, clean-up of perforations, and to improve near wellbore conditions in damaged high permeability formations.

To intervene in the propagation of a hydraulic fracture, two shock waves are created in the wellbore. The first one is due to the release of the electrical energy, while the second one is the result of the chemical thermite reaction of the nanoparticles initiated by the electrical energy. The process may result in two shock wave peaks, the first peak stemming from the electrical discharge and the second peak stemming from the thermite reaction. In many applications, the two shock wave peaks may not be distinguishable from one another if the shock waves occur within a short time of each other. The chemical thermite reaction may produce energy that may be significantly larger than the electrical energy. In some cases, the chemical thermite reaction may be an order of magnitude larger, thereby resulting in a significantly larger second peak. The amplitude of the shock wave, the distance between peaks, and the amount of energy released may be calculated to give the most benefit for a desired application. The distance between peaks is affected by distance between electrodes, time and level of electrical charge and discharge. Metal particles or nanoparticles are used to create the thermite reaction. Aluminum filament is a metal that is usually used for such a task, although other metals may be also used. The particles and/or nanoparticles can be introduced at different times from a downhole storage container that may be controlled from the surface. The control mechanism for the delivery of the particles or nanoparticles may be either electrical or by means of telemetry. The nanoparticles may also be simply injected from the surface. By coupling this invention with other stimulation techniques such as hydrojetting, acidizing, and closed fracture acidizing, an overall enhanced stimulation may be achieved. Pairing this invention with modified hydraulic fracturing techniques may be effective in the refracturing of horizontal wells because it focuses energy into a limited horizontal well interval.

A pulse power supply unit (PPS) has to be specifically designed for the space-constrained and high-pressure, high temperature borehole environment. The PPS is a bank of high-voltage capacitors configured with proprietary design topology and charged to a specific energy level. The charging is accomplished from a surface electrical power unit through a long (according to well depth) armored, coaxial cable at high voltage and frequency. The stored electrical energy, from a few tens to several hundred kilojoules (kJ) is then discharged in nanosecond to microsecond windows through a solid-state or electro-mechanical proprietary switch to a load. This load is a proprietary shock wave generator, which uses as input a high current electrical pulse of proprietary characteristics from the pulsed-power system. The electrical pulse carries power in the Giga-watt range. These pulses are generated at well site or in-situ above the rock strata, and transmitted via specially designed, insulated concentric steel tubing string to an array of nano-aluminum cartridges placed in a 10-30 ft long sonde. The high-power electrical discharges produce an electrical shock wave that generates a pressure shock wave and electromagnetic wave. The electric power release will transform the aluminum cartridges or the aluminum nanoparticles into fast expanding plasma in the water-filled borehole, sending supersonic stress waves to the surrounding rock. The stress wave pulses are precisely designed in terms of amplitude, rise time, and duration, such that the desired effect is produced. Multiple pulses may be produced. In one application, it may be desired to breakdown the formation by creating multiple radial fractures. In another application it may be desired to apply the shock wave during a stimulation/fracturing treatment.

This new technology contains Surface Unit (SU), a Bottom Unit (BU) and a Connecting Unit (CU). The SU consists of a high-power electrical pulsed-power module. The module generates a pulse of microseconds duration, delivering a high energy pulse across spark gap located in the BU. The pulsed power generated by the SU is conveyed by the CU to the BU. The BU is located at the bottom of an oil or gas well. The BU consists of an electrode with spark gap and an electrolyte (e.g., fresh or saline water, acid or dilute copper sulfate solution, etc). The CU serves as a conduit for both the pulsed-power and the intermittent supply of electrolyte to a storage chamber attached above the electrode in the BU.

The SU requires a normal electrical power supply of 220VAC. The SU consists of a high-voltage transformer, a battery or bank of ceramic or other suitable type of capacitors, a charging and discharging circuit, and other necessary electronic circuits for controlling pulse width and amplitude. After charging, the energy stored in the capacitor bank is discharged and delivered to the BU. The high energy released at the spark gap of the electrode in the BU converts the electrolyte into plasma of intense heat and pressure (exceeding 100-120 MPa), which sends shock waves propagating to the rock mass around it, and creates multiple fractures.

The capacitors employed in the intervention process are high capacity capacitors that charge very quickly and have the ability to discharge almost instantaneously. The discharged electricity creates a shock wave and also converts the aluminum (foil, particles, or nano particles) into plasma. The aluminum (or other reactive element) plasma reacts with aqueous fluids (water) in a thermite reaction that produces a huge amount of energy far exceeding the original electrical energy released by the capacitors causing larger shock waves.

Use of explosives for this application has been considered. However, explosives are not suitable in the present application, as they fragment the formation around the wellbore, producing the opposite effect than what is needed. The energy released by the capacitors and the subsequent energy produced by the thermite reaction produce a shock wave that reaches maximum pressure of about 200 MP (approximately 30,000 psi) with duration of several micro seconds. The shock wave will travel via the liquid inside the fracture and is sufficient to extend a fracture, open natural fracture, and/or dislodge proppant at the tip of fracture that may be preventing fracture propagation. Explosives, on the other hand, create extremely high pressure that could be in the millions of psi in just a few micro-second. This will tend to fragment the formation around the wellbore, which will disrupt the fracture propagation process.

In this application, the shock waves via the system may be applied a single or multiple times depending on situation and what is happening in the fracturing treatment. Applying explosives multiple times would just worsen the situation as it further fragments and damages the formation around the wellbore. It would probably reduce the formation around the wellbore to rubbles causing serious formation damage, serious wellbore integrity issues, and diminished fracture efficiency.

PROPOSED APPROACH EXAMPLES

The proposed approach is illustrated through two examples. The four fracturing modes introduced by Nolte and Smith (1981) can be used with a time exponent e vs. time plot to monitor the behavior of fractures during pumping. Values of e in the range of $$\frac{1}{4n+4} \leq e \leq \frac{1}{2n+3}$$

indicate that the created fracture is propagating under the assumptions of Perkins and Kern (1981), which are confined height, constant fracture compliance, and unresticted extension. Time exponent e≈1 usually means that fracture propagation has decreased significantly and instead fluid storage is taking place in the form of increasing fracture pressure and width. In addition, a rapid pressure drop i.e. e<<0 is the sign of rapid height growth. No certain explanation exists for a constant fracturing pressure trend (i.e. e≈0) and based on the succeeding pressure behavior, several interpretations are possible, including rapid height growth, increasing fracture compliance, and opening of fissures. In case of shale formations, the opening of fissures/natural fractures is the most probable cause.

Example 1

Shale Formation Job Design

This example is from a fracturing treatment performed in a horizontal well in Eagle Ford, a shale formation. This specific shale formation produces both gas and high-gravity oil and is mainly a clay-rich limestone with very low quartz content. This composition tends to make the shale less brittle (more ductile) with a low Young's Modulus of ~2×10E6 psi. Whole-core testing on the Eagle Ford shale indicates that because the rock is relatively soft, it is prone to proppant embedment. It is also naturally highly fractured. Several fracturing treatments have been analyzed and all have shown similar behavior that is demonstrated in in FIG. 3. The figure indicates that the main fracture had intercepted several major natural fractures that were opened. Each time the exponent dipped to a negative value is an indication of opening a major natural fracture. The recovery of exponent to the positive territory indicates that the fracture resumed propagation after packing the natural fracture with proppant.

Application of a pulse (or multiple pulses) at the time a natural fracture is observed will maximize the enhancement of the opening of said natural fractures. The example indicates that a hydraulic fracture will most probably intersect multiple natural fractures. Thus the ability to repeat a pulse on command is highly desirable. In the example illustrated in FIG. 3, it apparent that natural fractures completely open at times of 53, 60, 70, 77, etc. Applying the pressure pulse at time range of 50-55, 58-62, 68-72, 75-80 will yield enhanced complexity. That range will improve with field experience. The applied pulse(s) will widen the natural fractures forcing more proppant into the natural fracture. The pulse(s) would cause a shear effect that may slide the surfaces of the natural fractures against each other, causing self-propping effect

Example 2

FracPack Example

The second example is from a FracPack case that was originally analyzed by Pirayesh, et al. (2013) and given in FIG. 4. The sandout mode is indicated by the fracturing index increasing in value and approaching 1. The figure indicates that the hydraulic fracture was heading twice towards Sand Out at 8 and 12 minutes before it finally sanded out. Application of multiple shock wave signals at between 7-9 minutes and again from 11-14 minutes would produce more evenly distributed proppant inside the fracture and would delay the onset of sand out. Once the desired fracture length is achieved, one would stop applying the shock wave pulses.

SUMMARY

The examples illustrate that it is possible to detect the presence of natural fractures or sand out in real time. Application of pressure pulses (shock waves) would increase the chances of enhancing complexity in the case of natural fractures as illustrated in example 1, or creating delay in sand out as illustrated in example 2.

Linkage to Other Processes

The method described in this patent may be linked with evaluation of the fracture propagation through a fracture design simulator to calculate the distance to various events during the progress of the hydraulic fracturing process. This method may be also linked with the monitoring of seismic events of the fracture propagation to determine the distance and location of the various events during the progress of the hydraulic fracturing process. This linkage may be done in real time or subsequent to the treatment for further evaluation of the treatment and/or prediction of well and reservoir production.

NOMENCLATURE

C Constant
$C_{ff}$ Fracturing fluid compressibility, $psi^{-1}$
e Time exponent
E Young's modulus
E' Plain strain modulus
$K_{IC}$ Fracture toughness, $psi.in^{1/2}$
L Fracture length (tip to tip), ft
n Flow behavior index
p Net pressure, psi
$p_{cl}$ closure stress, psi
$q_i$ injection rate into one wing of the fracture, $ft^3/min$
$q_l$ Leak-off rate of one wing of the fracture, $ft^3/min$
t Time, min
$t_i$ Time of start of a new period, min
$V_f$ Fracture volume, $ft^3$
u Poisson's ratio It is claimed:

1. A method to influence real time propagation of a hydraulic fracture of a wellbore as injection of fracturing fluid occurs during a hydraulic fracturing treatment, the method comprising the steps of:

commencing injection of fracturing fluid into a wellbore to initiate and propagate a hydraulic fracture;

monitoring, as the injection of fracturing fluid occurs, hydraulic fracturing treatment pressure or one or more microseismic events generated by the propagating hydraulic fracture;

analyzing pressure-time data or microseismic event data of the propagating hydraulic fracture;

determining status of hydraulic fracture propagation from said pressure-time data or microseismic event data;

creating one or more shock waves from electrical energy; and applying said shock waves into the injected fracturing fluid inside the wellbore, as the injection of fracturing fluid occurs, for the purpose of creating a longer propped hydraulic fracture and/or enlarging one or more natural fractures intersecting the hydraulic fracture, the number of applications of said shock waves and timing of each application of said shock waves determined by said status of the hydraulic fracture propagation;

adding one or more metal filament, metal particles, or nanoparticles of element into the fracturing fluid to create one or more secondary shock waves by chemical thermite reaction for the purpose of enhancing far field hydraulic fracture complexity; and adjusting an amount and type of filament, metal particles, or nanoparticles to control amplitudes of pressure peaks of shock waves created by chemical thermite reaction and distance between pressure peaks of shock waves created by electrical energy and shock waves created by chemical thermite reaction.

2. The method of claim 1, wherein time at which metal particles or nanoparticles are delivered into a downhole assembly is controlled by a storage release mechanism.

3. The method of claim 1, wherein a storage release mechanism may be initiated from a surface by electric wireline, telemetry, or other mechanisms.

4. The method of claim 1, wherein the secondary shock waves are controlled from the surface of the wellbore by adjusting an amount and type of filament, metal particles, or nanoparticles.

5. The method of claim 1, wherein said pressure-time data and/or microseismic event data of the propagating hydraulic fracture are analyzed as the injection of fracturing fluid occurs.

6. The method of claim 1, wherein multiple charging and discharging of capacitors may be used during creation and propagation of the hydraulic fracture.

7. The method of claim 1, wherein distance between pressure peaks of created shock waves and/or amplitude of said peaks is controlled by distance between electrodes of capacitors, time of capacitor discharge, and level of electrical charge in said capacitors prior to said discharge.

8. The method of claim 1, wherein application of one or more shock waves as the injection of fracturing fluid occurs dislodge proppant of said hydraulic fracture or open said natural fractures.

9. The method of claim 1, wherein event of an impending sand out, application of one or more shock waves into the fracturing fluid as the injection of fracturing fluid occurs causes further propagation of the hydraulic fracture.

10. The method of claim 1, wherein the event of said hydraulic fracture intersecting said natural fractures, application of one or more shock waves into the fracturing fluid as the injection of fracturing fluid occurs increases conductivity of said natural fractures.

11. The method of claim 1, wherein the injection of fracturing fluid into a horizontal wellbore creates one or more simultaneous hydraulic fractures.

* * * * *